US011852375B2

(12) United States Patent
Smith

(10) Patent No.: US 11,852,375 B2
(45) Date of Patent: Dec. 26, 2023

(54) VENTILATION PARTITIONS AND SYSTEMS

(71) Applicant: 3Flow, Inc., Cary, NC (US)

(72) Inventor: Thomas C. Smith, Raleigh, NC (US)

(73) Assignee: 3Flow, Inc., Cary, NC (US)

( * ) Notice: Subject to any disclaimer, the term of this patent is extended or adjusted under 35 U.S.C. 154(b) by 214 days.

(21) Appl. No.: 17/360,106

(22) Filed: Jun. 28, 2021

(65) Prior Publication Data

US 2022/0010989 A1 Jan. 13, 2022

Related U.S. Application Data

(60) Provisional application No. 63/050,415, filed on Jul. 10, 2020.

(51) Int. Cl.

| | |
|---|---|
| ***F24F 7/003*** | (2021.01) |
| ***F24F 7/007*** | (2006.01) |
| ***F24F 8/22*** | (2021.01) |
| ***F24F 8/10*** | (2021.01) |
| *F24F 13/28* | (2006.01) |

(52) U.S. Cl.

CPC ..... *F24F 7/003* (2021.01); *F24F 7/007* (2013.01); *F24F 8/10* (2021.01); *F24F 8/22* (2021.01); *F24F 13/28* (2013.01)

(58) Field of Classification Search

CPC .... F24F 7/003; F24F 7/007; F24F 8/10; F24F 8/12; F24F 13/28

USPC ..... 454/167

See application file for complete search history.

(56) References Cited

U.S. PATENT DOCUMENTS 3,757,495 A * 9/1973 Sievers ..... F24F 8/80 96/139
5,264,015 A * 11/1993 Matsui ..... F24F 1/0071 55/467
5,616,172 A * 4/1997 Tuckerman ..... F24F 1/0071 96/57
5,997,619 A * 12/1999 Knuth ..... B01D 46/0038 55/385.2
6,318,113 B1 * 11/2001 Levy ..... F24F 3/044 62/426

(Continued)

FOREIGN PATENT DOCUMENTS

GB 2106240 A 4/1983
JP 2000342921 A * 12/2000

OTHER PUBLICATIONS

"Examination Report", CA Application No. 3, 123,811, dated Nov. 2, 2022, 5 pp.

*Primary Examiner* — Avinash A Savani
*Assistant Examiner* — Dana K Tighe
(74) *Attorney, Agent, or Firm* — Myers Bigel, P.A.

(57) ABSTRACT

A ventilation system for a space includes an air supply partition configured to cause filtered air to flow into an area of the space, and an air exhaust partition in spaced-apart relationship with the air supply partition and configured to cause air to be drawn in and filtered from the area. The air supply partition and the air exhaust partition create a "push-pull" air flow across the area. A ventilation partition includes air inlets in a first portion of the housing, air outlets in a second portion of the housing, a filter, and a fan configured to draw air in through the air inlets, through the filter, and out through the air outlets. The partition is a portable, free-standing structure configured to be supported by a surface, such as a floor of a room in which the partition is located.

18 Claims, 5 Drawing Sheets

(56) References Cited

U.S. PATENT DOCUMENTS

| | | | | |
|---|---|---|---|---|
| 6,481,228 | B1 * | 11/2002 | Chiang | F24F 1/0035 62/223 |
| 7,334,424 | B2 * | 2/2008 | Park | F24F 1/005 62/428 |
| 8,430,940 | B2 * | 4/2013 | Nguyen | B08B 15/04 132/73 |
| 9,310,088 | B2 * | 4/2016 | Melikov | G16H 50/80 |
| 2004/0192186 | A1 * | 9/2004 | Bourgeois | B01D 46/12 55/385.2 |

* cited by examiner

VENTILATION PARTITIONS AND SYSTEMS

RELATED APPLICATION

This application claims the benefit of and priority to U.S. Provisional Patent Application No. 63/050,415 filed Jul. 10, 2020, the disclosure of which is incorporated herein by reference as if set forth in its entirety.

FIELD OF THE INVENTION

The present invention relates generally to ventilation systems and, more particularly, to ventilation systems for reducing pathogen transmission.

BACKGROUND OF THE INVENTION

The emergence of respiratory diseases, such as the severe acute respiratory syndrome (SARS) epidemic in 2003, the H1N1 influenza epidemic in 2011, and the current COVID-19 pandemic, highlights the importance of controlling the spread of pathogens exhaled by persons within buildings, particularly healthcare facilities. Unfortunately, conventional ventilation systems in healthcare facilities can exacerbate the spread of pathogens from patients within those facilities.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

Embodiments of the present invention provide portable ventilation partitions and systems that can be used in various in-door applications, including healthcare facilities, office workplaces, restaurants, etc. These ventilations systems are effective in capturing pathogens exhaled by persons and help prevent pathogen transmission throughout a facility in which a person is located.

According to some embodiments of the present invention, a ventilation partition includes an elongate housing, at least one air inlet in a first portion of the housing, at least one air outlet in a second portion of the housing that is vertically spaced apart from the first portion, at least one filter, and at least one fan configured to draw air in through the at least one air inlet, through the at least one filter, and out through the at least one air outlet. The partition is a portable, free-standing structure configured to be supported by a surface, such as a floor of a room in which the partition is located. In some embodiments, the partition includes at least one UV light source configured to irradiate air flowing between the at least one air inlet and the at least one air outlet with UV radiation to substantially reduce airborne contaminants/pathogens.

In some embodiments, at least one air outlet is located in an upper portion of the housing and the at least one air inlet is located in a lower portion of the housing. In this embodiment, the at least one fan may be located between these upper and lower portions. The at least one filter, such as a HEPA filter, and the UV light source also may be located between these upper and lower portions, also.

In some embodiments, the housing has a rectangular configuration with opposite front and rear walls, opposite side walls, and opposite top and bottom walls. The at least one air inlet is in a lower portion of the rear wall, and the at least one air outlet is in an upper portion of the front wall. In other embodiments, the at least one air inlet comprises at least one air inlet in a lower portion of the rear wall and at least one air inlet in a lower portion of one of the side walls. In other embodiments, the at least one air outlet comprises at least one air outlet in an upper portion of the front wall and at least one air outlet in an upper portion of one of the side walls.

In some embodiments, the at least one air outlet is movable so that a direction of an air flow path from the at least one air outlet can be controlled.

In some embodiments, the housing has a rectangular configuration with a height of between about sixty inches (60") and seventy two inches (72"), and a width of between about twenty four inches (24") and ninety six inches (96").

According to some embodiments of the present invention, a ventilation system for an interior space includes an air supply partition configured to cause filtered air to flow into an area of the interior space, and an air exhaust partition in spaced-apart relationship with the air supply partition and configured to cause air to be drawn in and filtered from the area. The air supply partition is a portable, free-standing structure configured to be supported in an upright orientation by a floor of the interior space. The air supply partition includes a housing having an internal chamber, a plurality of air inlet apertures in fluid communication with the internal chamber, and a plurality of air outlet apertures in fluid communication with the internal chamber. At least one filter, such as a HEPA filter, is positioned within the internal chamber. The air supply partition includes at least one fan that is configured to cause air to be drawn in through the air inlet apertures, through the at least one filter, and out through the air outlet apertures into the area. In some embodiments, the air supply partition housing has a rectangular configuration with a height of between about sixty inches (60") and seventy two inches (72"), and a width of between about forty eight inches (48") and eighty four inches (84").

The air exhaust partition is a portable, free-standing structure configured to be supported in an upright orientation by a floor of the interior space. The air exhaust partition includes a housing having an internal chamber, a plurality of air inlet apertures in fluid communication with the internal chamber, and a plurality of air outlet apertures in fluid communication with the internal chamber. At least one filter, such as a HEPA filter, is positioned within the internal chamber. The air exhaust partition includes at least one fan that is configured to cause air from the area to be drawn in through the air inlet apertures, through the at least one filter, and out through the air outlet apertures. In some embodiments, the air exhaust partition housing has a rectangular configuration with a height of between about sixty inches (60") and seventy two inches (72"), and a width of between about forty eight inches (48") and eighty four inches (84").

In some embodiments, the air exhaust partition also includes at least one UV light source configured to irradiate air flowing through the air exhaust partition housing with UV radiation in order to substantially reduce airborne contaminants/pathogens.

According to other embodiments of the present invention, a ventilation system for an interior space having first and second adjacent areas includes an air supply partition, a first air exhaust partition, and a second air exhaust partition. The air supply partition is positioned between the first and second areas and is configured to cause filtered air to flow into the first area and into the second area. The first air exhaust partition is positioned in spaced-apart relationship with the air supply partition and is configured to cause air to be drawn in and filtered from the first area. The second air exhaust partition is positioned in spaced-apart relationship with the air supply partition and is configured to cause air to be drawn in and filtered from the second area.

The air supply partition is a portable, free-standing structure configured to be supported in an upright orientation by a floor of the interior space. The air supply partition includes a housing having an internal chamber, a plurality of air inlet apertures in fluid communication with the internal chamber, a first plurality of air outlet apertures in fluid communication with the internal chamber, and a second plurality of air outlet apertures in fluid communication with the chamber. In some embodiments, the first and second plurality of air outlet apertures are positioned on respective opposite sides of the air supply partition. At least one filter, such as a HEPA filter, is positioned within the internal chamber. The air supply partition includes at least one fan that is configured to cause air to be drawn in through the air inlet apertures, through the at least one filter, and out through both the first and second plurality of air outlet apertures and into the first and second areas, respectively. In some embodiments, the air supply partition housing has a rectangular configuration with a height of between about sixty inches (60") and seventy two inches (72"), and a width of between about forty eight inches (48") and eighty four inches (84").

The first air exhaust partition is a portable, free-standing structure configured to be supported in an upright orientation by a floor of the interior space. The first air exhaust partition includes a housing having an internal chamber, a plurality of air inlet apertures in fluid communication with the internal chamber, and a plurality of air outlet apertures in fluid communication with the internal chamber. At least one filter, such as a HEPA filter, is positioned within the internal chamber. The first air exhaust partition includes at least one fan that is configured to cause air to be drawn in from the first area of the interior space through the air inlet apertures, through the at least one filter, and out through the air outlet apertures. In some embodiments, the first air exhaust partition housing has a rectangular configuration with a height of between about sixty inches (60") and seventy two inches (72"), and a width of between about forty eight inches (48") and eighty four inches (84").

In some embodiments, the first air exhaust partition includes at least one UV light source configured to irradiate air flowing through the housing with UV radiation in order to substantially reduce airborne contaminants/pathogens.

The second air exhaust partition is a portable, free-standing structure configured to be supported in an upright orientation by a floor of the interior space. The second air exhaust partition includes a housing having an internal chamber, a plurality of air inlet apertures in fluid communication with the internal chamber, and a plurality of air outlet apertures in fluid communication with the internal chamber. At least one filter, such as a HEPA filter, is positioned within the internal chamber. The second air exhaust partition includes at least one fan that is configured to cause air to be drawn in from the second area of the interior space through the air inlet apertures, through the at least one filter, and out through the air outlet apertures. In some embodiments, the second air exhaust partition housing has a rectangular configuration with a height of between about sixty inches (60") and seventy two inches (72"), and a width of between about forty eight inches (48") and eighty four inches (84").

In some embodiments, the second air exhaust partition includes at least one UV light source configured to irradiate air flowing through the housing with UV radiation in order to substantially reduce airborne contaminants/pathogens.

According to other embodiments of the present invention, a ventilation system for an interior space having first and second adjacent areas includes an air exhaust partition, a first air supply partition, and a second air supply partition. The air exhaust partition is positioned between the first and second areas and is configured to cause air to be drawn in and filtered from both the first area and from the second area. The first air supply partition is positioned in spaced-apart relationship with the air exhaust partition and is configured to cause filtered air to flow into the first area. The second air supply partition is positioned in spaced-apart relationship with the air exhaust partition and is configured to cause filtered air to flow into the second area.

The air exhaust partition is a portable, free-standing structure configured to be supported in an upright orientation by a floor of the interior space. The air exhaust partition includes a housing having an internal chamber, a first plurality of air inlet apertures in fluid communication with the internal chamber, a second plurality of air inlet apertures in fluid communication with the internal chamber, and a plurality of air outlet apertures in fluid communication with the chamber. Air from the first area is drawn in through the first plurality of air inlet apertures, and air from the second area is drawn in through the second plurality of air inlet apertures. In some embodiments, the first and second plurality of air inlet apertures are positioned on respective opposite sides of the air exhaust partition. At least one filter, such as a HEPA filter, is positioned within the internal chamber. The air exhaust partition includes at least one fan configured to cause air to be drawn through the first and second plurality of air inlet apertures, through the at least one filter, and out through the air outlet apertures. In some embodiments, the air exhaust partition housing has a rectangular configuration with a height of between about sixty inches (60") and seventy two inches (72"), and a width of between about forty eight inches (48") and eighty four inches (84").

In some embodiments, the air exhaust partition further includes at least one UV light source configured to irradiate air flowing through the housing with UV radiation in order to substantially reduce airborne contaminants/pathogens.

The first air supply partition is a portable, free-standing structure configured to be supported in an upright orientation by a floor of the interior space. The first air supply partition includes a housing having an internal chamber, a plurality of air inlet apertures in fluid communication with the internal chamber, and a plurality of air outlet apertures in fluid communication with the internal chamber. At least one filter, such as a HEPA filter, is positioned within the internal chamber. The first air supply partition includes at least one fan that is configured to cause air to be drawn in through the air inlet apertures, through the at least one filter, and out through the air outlet apertures into the first area. In some embodiments, the air supply partition housing has a rectangular configuration with a height of between about sixty inches (60") and seventy two inches (72"), and a width of between about forty eight inches (48") and eighty four inches (84").

The second air supply partition is a portable, free-standing structure configured to be supported in an upright orientation by a floor of the interior space. The second air supply partition includes a housing having an internal chamber, a plurality of air inlet apertures in fluid communication with the internal chamber, and a plurality of air outlet apertures in fluid communication with the internal chamber. At least one filter, such as a HEPA filter, is positioned within the internal chamber. The second air supply partition includes at least one fan that is configured to cause air to be drawn in through the air inlet apertures, through the at least one filter, and out through the air outlet apertures into the second area. In some embodiments, the air supply partition housing has a rectangular configuration with a height of between about sixty inches (60") and seventy two inches (72"), and a width of between about forty eight inches (48") and eighty four inches (84").

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate various embodiments of the present invention. The drawings and description together serve to fully explain embodiments of the present invention.

DETAILED DESCRIPTION

Figure 1:
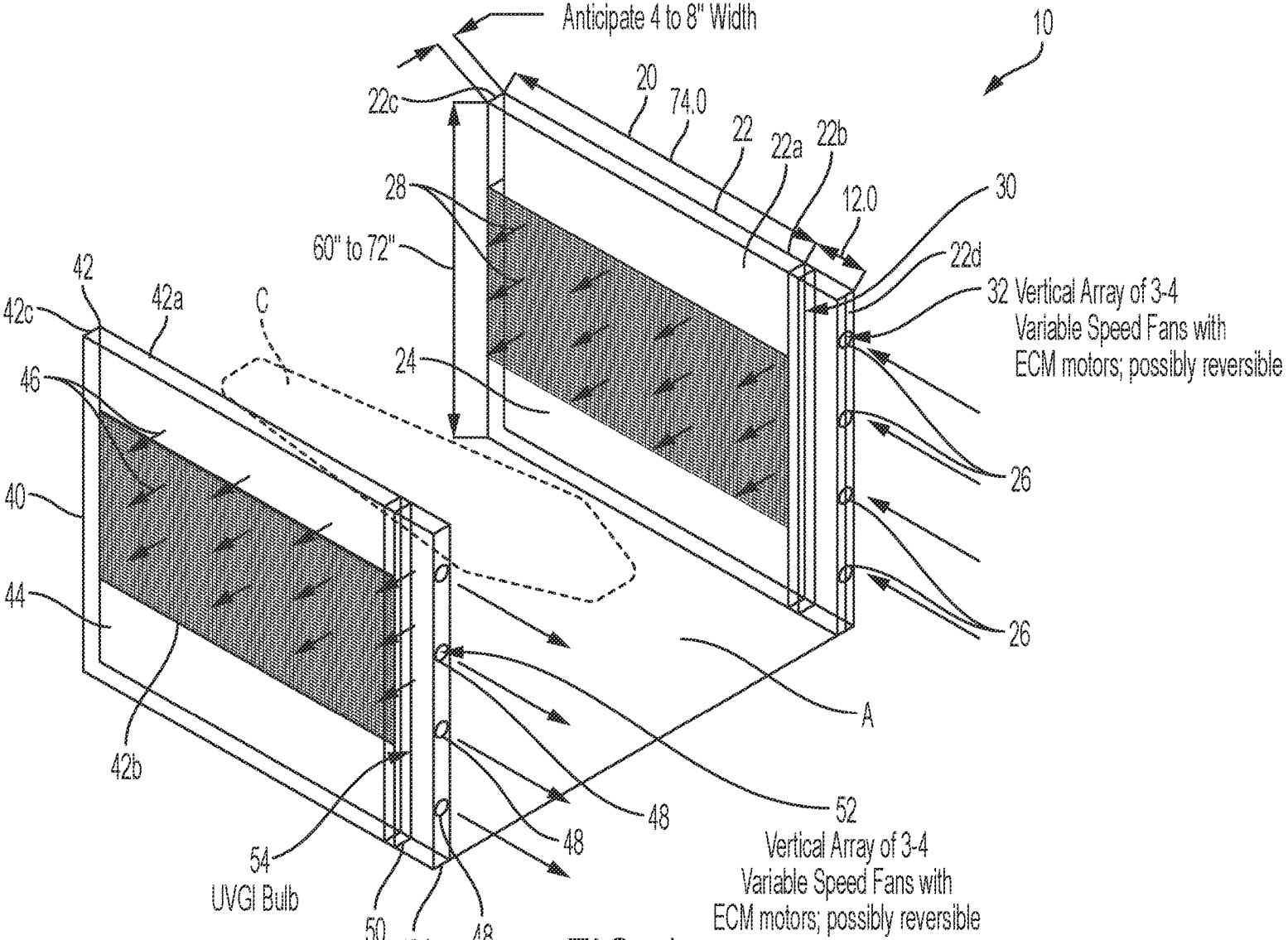
FIG. 1 is a perspective view of a ventilation system for an interior space, according to some embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain components or features may be exaggerated for clarity, and broken lines illustrate optional features or operations unless specified otherwise. In addition, the sequence of operations (or steps) is not limited to the order presented in the figures and/or claims unless specifically indicated otherwise. Features described with respect to one figure or embodiment can be associated with another embodiment or figure although not specifically described or shown as such.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

When an element is referred to as being "connected", "coupled", "responsive", or variants thereof to another element, it can be directly connected, coupled, or responsive to the other element or intervening elements may be present. In contrast, when an element is referred to as being "directly connected", "directly coupled", "directly responsive", or variants thereof to another element, there are no intervening elements present. Like numbers refer to like elements throughout. Furthermore, "coupled", "connected", "responsive", or variants thereof as used herein may include wirelessly coupled, connected, or responsive. As used herein, the singular forms "a", "an" and "the" are intended to include the plural forms as well, unless the context clearly indicates otherwise. Well-known functions or constructions may not be described in detail for brevity and/or clarity. The term "and/or" includes any and all combinations of one or more of the associated listed items.

As used herein, the terms "comprise", "comprising", "comprises", "include", "including", "includes", "have", "has", "having", or variants thereof are open-ended, and include one or more stated features, integers, elements, steps, components or functions but does not preclude the presence or addition of one or more other features, integers, elements, steps, components, functions or groups thereof. Furthermore, as used herein, the common abbreviation "e.g.", which derives from the Latin phrase "exempli gratia," may be used to introduce or specify a general example or examples of a previously mentioned item, and is not intended to be limiting of such item. The common abbreviation "i.e.", which derives from the Latin phrase "id est," may be used to specify a particular item from a more general recitation.

It will be understood that although the terms first, second, third, etc. may be used herein to describe various elements/operations, these elements/operations should not be limited by these terms. These terms are only used to distinguish one element/operation from another element/operation. Thus a first element/operation in some embodiments could be termed a second element/operation in other embodiments without departing from the teachings of present inventive concepts. The same reference numerals or the same reference designators denote the same or similar elements throughout the specification.

The term "about", as used herein with respect to a value or number, means that the value or number can vary by +/−twenty percent (20%).

Referring now to FIG. 1, a ventilation system 10 for an interior space is illustrated. The ventilation system 10 includes an air supply partition 20 configured to cause filtered air to flow into an area A of the interior space, and an air exhaust partition 40 in spaced-apart relationship with the air supply partition 20 and configured to cause air to be drawn in and filtered from the area A. The area A may include a dentist chair C or other patient support device (i.e., bed, chair, etc.). In other applications, the area A may be a dining area for a restaurant or other eating establishment, a work area of an office building, a garage, etc. Embodiments of the present invention can be utilized within any type of area and are not limited to the areas described herein. The air supply partition 20 and the air exhaust partition 40 together create a "push-pull" air flow across the area A. Both the air supply partition 20 and the air exhaust partition 40 are portable, free-standing structures that are configured to be supported in an upright orientation by a floor. Air supply partitions 20 and air exhaust partitions 40 are preferably light in weight to facilitate easy installation and removal within an interior space.

The illustrated air supply partition 20 has a housing 22 that is rectangular-shaped with opposite first and second faces 22*a*, 22*b*, and opposite first and second sides 22*c*, 22*d*. In some embodiments, the housing 22 has a height of between about sixty inches (60") and seventy two inches (72"), and a width of between about forty eight inches (48") and eighty four inches (84"). However, an air supply partition 20 according to embodiments of the present invention is not limited to a rectangular shape or to these dimensions. The air supply partition 20 may have various shapes/configurations, as well as various other dimensions.

The housing 22 has an internal chamber 24, a plurality of air inlet apertures 26 in the second side 22*d* that are in fluid communication with the internal chamber 24, and a plurality of air outlet apertures 28 in the first face 22*a* that are in fluid communication with the internal chamber 24. At least one filter 30, such as a HEPA filter, is positioned within or otherwise in communication with the internal chamber 24. The air supply partition 20 includes at least one fan 32 that is configured to cause air to be drawn in through the air inlet apertures 26, through the at least one filter 30, and out through the air outlet apertures 28 into the area A. In some embodiments, a vertical array of fans 32 are utilized. Each fan 32 may be a variable speed fan driven by an electronically commutated motor (ECM), for example. However, various types of fans/motors may be utilized.

The illustrated air exhaust partition 40 has a housing 42 that is rectangular-shaped with opposite first and second faces 42*a*, 42*b*, and opposite first and second sides 42*c*, 42*d*. In some embodiments, the housing 42 has a height of between about sixty inches (60") and seventy two inches (72"), and a width of between about forty eight inches (48") and eighty four inches (84"). However, an air exhaust partition 40 according to embodiments of the present invention is not limited to a rectangular shape or to these dimensions. The air exhaust partition 40 may have various shapes/configurations, as well as various other dimensions.

The housing 42 has an internal chamber 44, a plurality of air inlet apertures 46 in the first face 42*a* that are in fluid communication with the internal chamber 44, and a plurality of air outlet apertures 48 in the second side 42*d* that are in fluid communication with the internal chamber 44. At least one filter 50 is positioned within or otherwise in communication with the internal chamber 44. The air exhaust partition 40 includes at least one fan 52 that is configured to cause air from the area A to be drawn in through the air inlet apertures 46 in the first face 42*a*, through the at least one filter 50, and out through the air outlet apertures 48 in the second side 42*d* of the housing 42. In some embodiments, a vertical array of fans 52 are utilized. Each fan 52 may be a variable speed fan driven by an ECM motor. However, various types of fans/motors may be utilized.

In operation, air is drawn in through the second side 22*d* of the air supply partition 20 via air inlet apertures 26, filtered, and then forced out through the first face 22*a* of the partition and across the area A. The air supply partition 20 utilizes directional displacement to help dilute and move airborne contaminants towards the air exhaust partition 40 in order to mitigate the spread of pathogens from persons within the area A. Air is drawn in through the first face 42*a* of the air exhaust partition 40, filtered, and exhausted harmlessly within the interior space through the air outlet apertures 48 in the second side 42*d* of the air exhaust partition 40. This configuration of the air supply partition 20 and the air exhaust partition 40 creates the push-pull airflow across the area A which helps remove pathogens within the area A.

In some embodiments, the air exhaust partition 40 includes at least one UV light source 54 that is configured to irradiate air flowing through the air exhaust partition housing with UV radiation. UV radiation can be effective in substantially reducing various contaminants and pathogens, including bacteria and viruses.

In some embodiments, an air supply partition can be configured to cause air to be supplied into two adjacent areas. For example, air outlet apertures can be formed in both the first and second faces 22*a*, 22*b* of the air supply partition housing 22 illustrated in FIG. 1. This allows for a single air supply partition 20 to force air into two different areas. Similarly, an air exhaust partition 40 according to some embodiments of the present invention can be configured to cause air to be drawn in from two adjacent areas. For example, air inlet apertures can be formed in both the first and second faces 42*a*, 42*b* of the air exhaust partition housing 42 illustrated in FIG. 1. This allows for a single air exhaust partition 40 to draw air in from two different areas.

Figure 2:
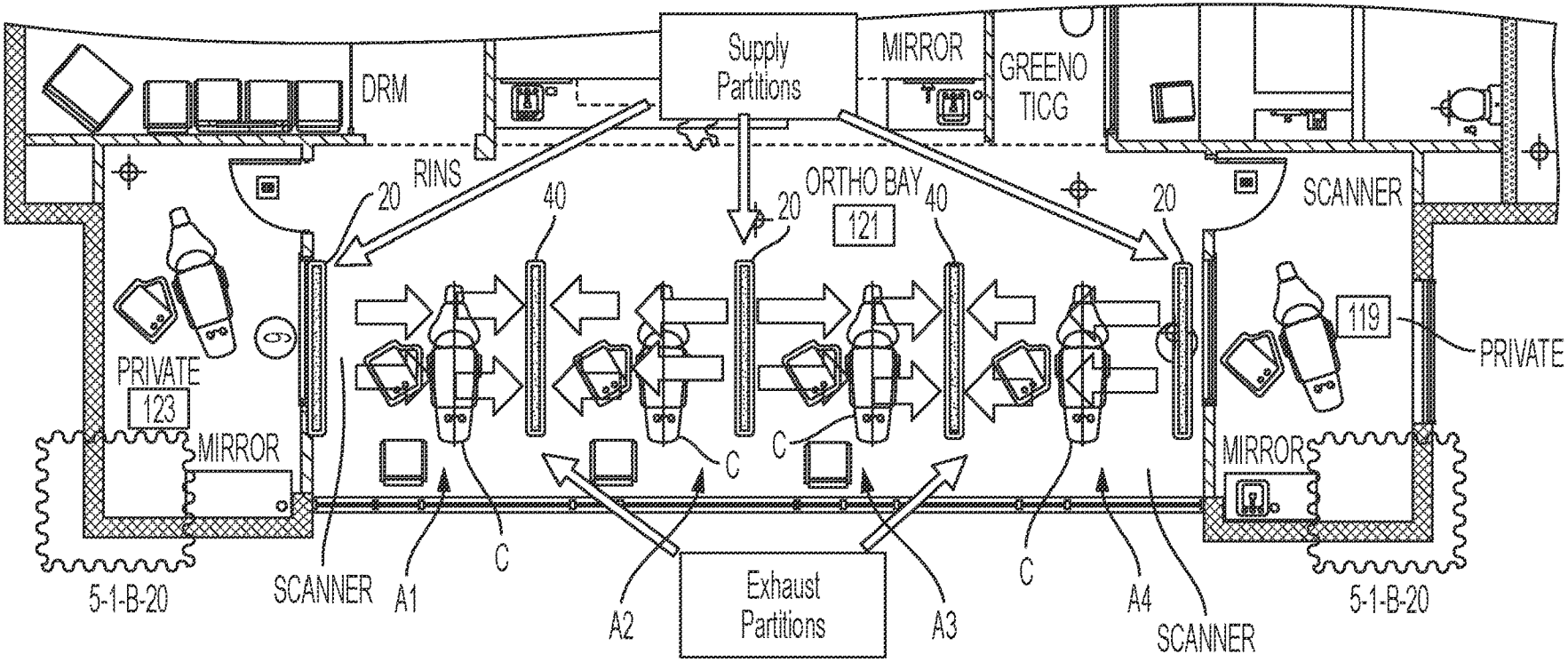
FIG. 2 is a plan view of a ventilation system for multiple areas of an interior space, according to some embodiments of the present invention.

FIG. 2 illustrates a ventilation system for use with multiple areas $A_1$, $A_2$, $A_3$, $A_4$ of an interior space, according to some embodiments of the present invention. Each of the areas $A_1$, $A_2$, $A_3$, $A_4$ may include a dentist chair C or other patient support device (i.e., bed, chair, etc.). In other applications, each of the areas $A_1$, $A_2$, $A_3$, $A_4$ may be a dining area, for example, for a restaurant or other eating establishment for customers, a work area within an office building, a garage, etc. Embodiments of the present invention can be utilized within any type of area and are not limited to the areas described herein. In the illustrated embodiment, the two air exhaust partitions 40 are configured to draw air in from adjacent areas. For example, the air exhaust partition 40 positioned between areas $A_1$ and $A_2$ is configured to draw air in from areas $A_1$ and $A_2$, and the air exhaust partition 40 positioned between areas $A_3$ and $A_4$ is configured to draw air in from areas $A_3$ and $A_4$. The air supply partition 20 located in area $A_1$ is configured to supply air across area $A_1$, as illustrated. The air supply partition 20 located in area $A_4$ is configured to supply air across area $A_4$, as illustrated. The air supply partition 20 positioned between areas $A_2$ and $A_3$ is configured to supply air across area $A_2$, and across area $A_3$, as illustrated.

Figure 3:
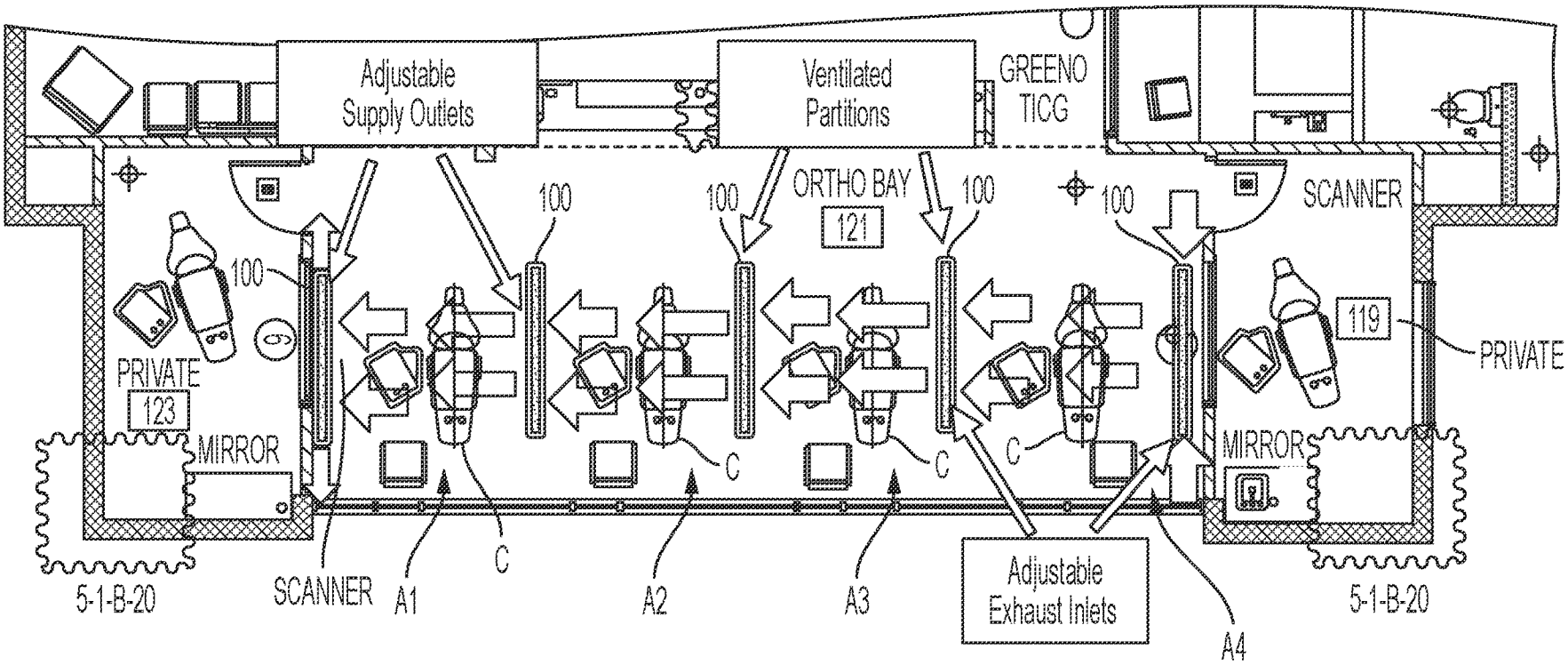
FIG. 3 is a plan view of a ventilation system for multiple areas of an interior space, according to some embodiments of the present invention.
Figure 4:
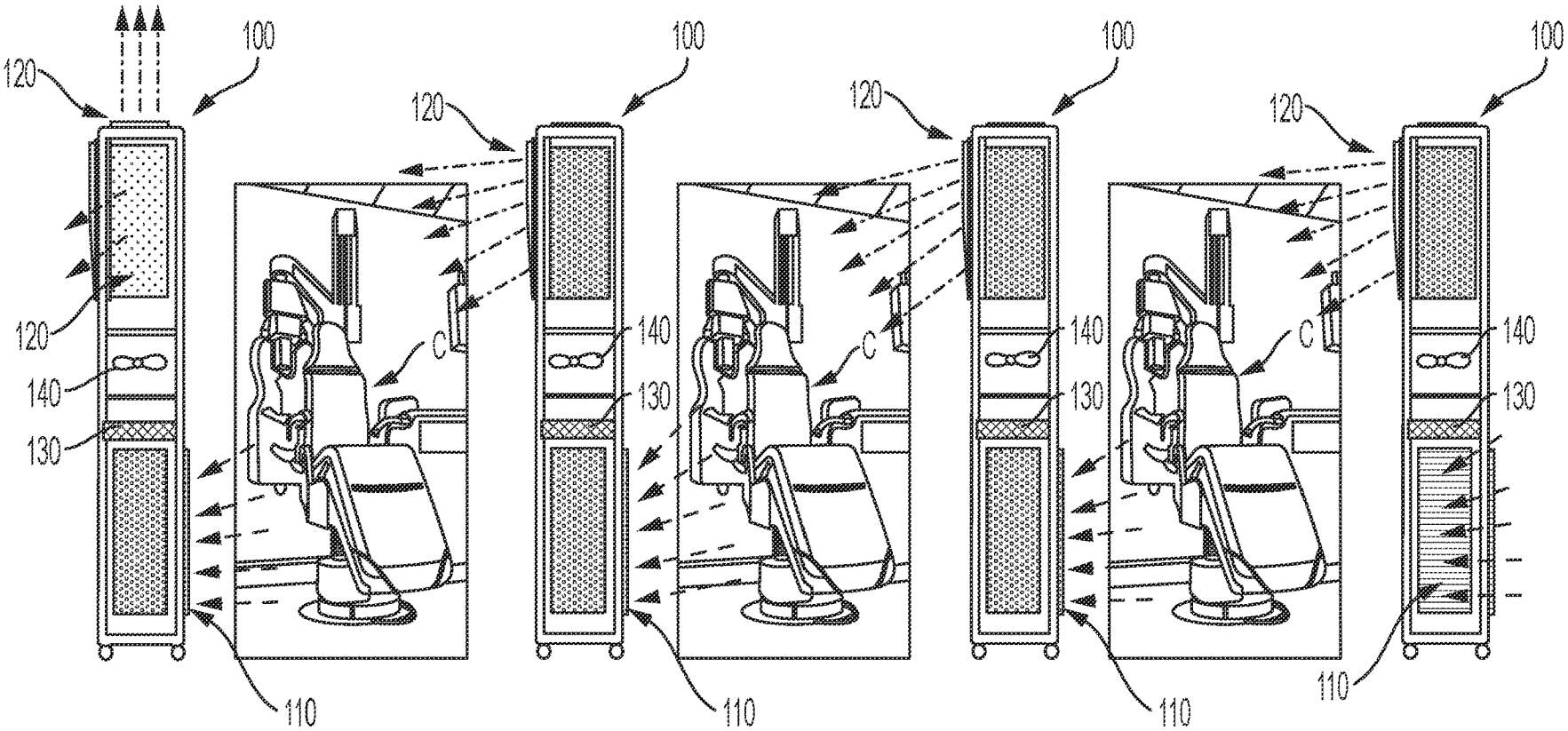
FIG. 4 illustrates air a plurality of ventilation partitions that both supply air and exhaust air, according to some embodiments of the present invention.

FIG. 3 illustrates a ventilation system for use with multiple areas $A_1$, $A_2$, $A_3$, $A_4$ of an interior space, according to some embodiments of the present invention. The four areas $A_1$, $A_2$, $A_3$, $A_4$ are separated by ventilation partitions 100. Each of the areas $A_1$, $A_2$, $A_3$, $A_4$ may include a dentist chair C or other patient support device (i.e., bed, chair, etc.). In other applications, each of the areas $A_1$, $A_2$, $A_3$, $A_4$ may be a dining area, for example, for a restaurant or other eating establishment for customers, a work area within an office building, a garage, etc. In the illustrated embodiment, each one of the ventilation partitions 100 is configured to both supply and exhaust air so as to create a push/pull airflow system that helps protect anyone in close contact with a potentially infected person. Together, the partitions are daisy chained to create a sweep of filtered air across the areas $A_1$, $A_2$, $A_3$, $A_4$ in the same direction, as illustrated. Each partition 100 may contain one or more variable speed fans 140, HEPA filters 130 and an optional UV light source for moving, filtering and decontaminating the airflow from intake to exhaust, as described above. The partitions 100 can be stand alone or two may be positioned to form a pair to serve as a push pull contaminant removal system.

Referring to FIGS. 4 and 5A-5C, the ventilation partitions 100 are illustrated in greater detail. Flow for the ventilation panels 100 is drawn via one or more fans 140 from an interior space through exhaust inlets 110 (which can be at a selectable location on the partition), filtered via one or more filters 130 and/or decontaminated with UV light, and then discharged as supply from selectable outlets 120 located on the front, top or side of the partition 100. Depending on placement of the partition 100, such as against a wall, the exhaust inlets 110 or supply outlets 120 can be changed to the top or sides of the partition 110 with blanking panels or via other mechanisms, such as closeable outlets and inlets. In addition, the supply outlets 120 may be movable or otherwise adjustable so that a direction of an air flow path therefrom may be adjusted. The exhaust inlets 110 also may be movable or otherwise adjustable so as to control the direction from which air is drawn therein.

Figures 5A, 5B, 5C:
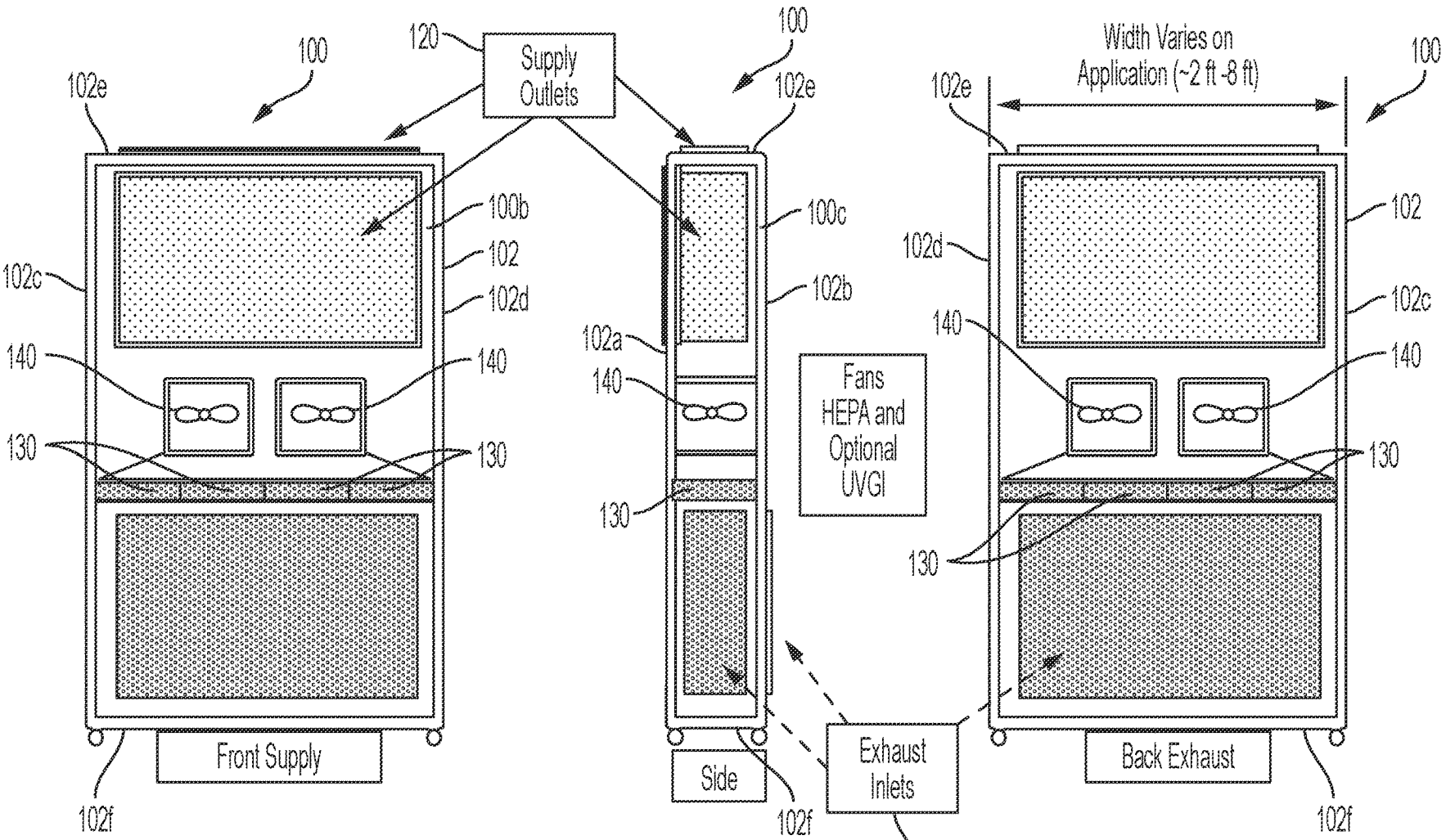
FIGS. 5A, 5B, 5C are respective front, side and rear views of one of the ventilation partitions of FIG. 4.

FIGS. 5A, 5B, 5C are respective front, side and rear views of a ventilation partition 100 according to some embodiments of the present invention. The illustrated partition 100 has an elongate housing 102 with a rectangular configuration. The illustrated housing 102 includes opposite front and rear walls 102*a*, 102*b*, opposite side walls 102*c*, 102*d*, and opposite top and bottom walls 102*e*, 102*f*. However, a partition 100 according to embodiments of the present invention is not limited to a rectangular shape. The partition 100 may have various shapes, configurations and sizes. In the illustrated embodiment, air supply outlets 120 are located in the upper portion of the housing and specifically in the upper portion of front wall 102*a*, the upper portion of side wall 102*d*, and in the top wall 102*e*. Air exhaust inlets 110 are located in the lower portion of the housing 102 and specifically in the lower portion of rear wall 102*b* and in the lower portion of side wall 102*d*. In the illustrated embodiment, the fans 140 are located between the upper and lower portions of the housing 102. The one or more filters 130, and the UV light source are also located between these upper and lower portions. However, in other embodiments, the locations of the air exhaust inlets 110 and air supply outlets 120 can be reversed (i.e., the air exhaust inlets 110 can be in an upper portion of the housing 102 and the air supply outlets 120 can be in a lower portion of the housing 102).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A ventilation system, comprising:

an air supply partition configured to cause filtered air to flow into a first area, wherein the air supply partition comprises:

a first housing comprising opposite first and second faces, opposite first and second sides, a first internal chamber, a plurality of first air inlet apertures in the first housing second side that are in fluid communication with the first internal chamber, and a plurality of first air outlet apertures in the first face that are in fluid communication with the first internal chamber;

at least one first filter positioned within the first internal chamber; and a vertical array of first fans on the first housing second side that are configured to cause the air to be drawn in through the first air inlet apertures, through the at least one first filter, and out through the first air outlet apertures; and an air exhaust partition in spaced-apart relationship with the air supply partition and configured to cause the air to be drawn in and filtered from the first area, wherein the air exhaust partition comprises:

a second housing comprising opposite first and second faces, opposite first and second sides, a second internal chamber, a plurality of second air inlet apertures in the second housing first face that are in fluid communication with the second internal chamber, and a plurality of second air outlet apertures in the second housing second side that are in fluid communication with the second internal chamber;

at least one second filter positioned within the second internal chamber; and a vertical array of second fans on the second housing second side that are configured to cause the air to be drawn in through the second air inlet apertures, through the at least one second filter, and out through the second air outlet apertures.

2. The ventilation system of claim 1, wherein the vertical array of first fans comprises at least three fans, and wherein the vertical array of second fans comprises at least three fans.

3. The ventilation system of claim 1, wherein the first housing is a portable, free-standing structure configured to be supported by a floor of the first area, and wherein the second housing is a portable, free-standing structure configured to be supported by the floor of the first area.

4. The ventilation system of claim 3, wherein the first housing and the second housing each have a rectangular configuration with a height of between about sixty inches (60") and seventy two inches (72"), and a width of between about forty eight inches (48") and eighty four inches (84").

5. The ventilation system of claim 1, wherein the vertical array of first fans and vertical array of second fans each comprise variable speed fans.

6. The ventilation system of claim 1, wherein the air exhaust partition further comprises at least one UV light source configured to irradiate air flowing through the housing with UV radiation.

7. The ventilation system of claim 1, wherein the first housing of the air supply partition is-further comprises a plurality of third air outlet apertures in the first housing second face that are in fluid communication with the first internal chamber, and wherein the filtered air flows through the third air outlets into a second area adjacent the first area.

8. The ventilation system of claim 1, wherein the second housing of the air exhaust partition further comprises a plurality of third air inlet apertures in the second housing second face that are in fluid communication with the second internal chamber, and wherein the air is drawn in through the third air inlets and filtered from a second area adjacent the first area.

9. A ventilation partition, comprising:

a housing, comprising opposite first and second faces, opposite first and second sides, and an internal chamber;

a plurality of air inlets in the second side of the housing that are in fluid communication with the internal chamber;

a plurality of air outlets in the first face of the housing that are in fluid communication with the internal chamber;

at least one filter positioned within the internal chamber; and a vertical array of fans on the second side of the housing that are configured to draw air in through the plurality of air inlets, through the at least one filter, and out through the plurality of air outlets.

10. The ventilation partition of claim 9, wherein the housing is a portable, free-standing structure configured to be supported by a surface.

11. The ventilation partition of claim 9, further comprising at least one UV light source configured to irradiate air flowing between the at least one air inlet and the at least one air outlet with UV radiation.

12. The ventilation partition of claim 9, wherein the vertical array of fans comprises variable speed fans.

13. The ventilation partition of claim 9, wherein the plurality of air outlets are movable so that a direction of an air flow path from the plurality of air outlets can be changed.

14. The ventilation partition of claim 9, wherein the housing has a rectangular configuration with a height of between about sixty inches (60") and seventy two inches (72"), and a width of between about twenty four inches (24") and ninety six inches (96").

15. A ventilation partition, comprising:

a housing, comprising opposite first and second faces, opposite first and second sides, and an internal chamber;

a plurality of air inlets in the first face of the housing that are in fluid communication with the internal chamber;

a plurality of air outlets in the second side of the housing that are in fluid communication with the internal chamber;

at least one filter positioned within the internal chamber; and a vertical array of fans on the second side of the housing that are configured to draw air in through the plurality of air inlets, through the at least one filter, and out through the plurality of air outlets.

16. The ventilation partition of claim 15, wherein the housing is a portable, free-standing structure configured to be supported by a surface.

17. The ventilation partition of claim 15, further comprising at least one UV light source configured to irradiate air flowing between the plurality of air inlets and the plurality of air outlets with UV radiation.

18. The ventilation partition of claim 15, wherein the vertical array of fans comprises variable speed fans.

* * * * *